US007942171B2

(12) United States Patent
Hartley, III

(10) Patent No.: US 7,942,171 B2
(45) Date of Patent: May 17, 2011

(54) DEVICE AND METHOD FOR FILLING MULTIPLE SANDBAGS AT A TIME

(75) Inventor: Joseph W. Hartley, III, Kula, HI (US)

(73) Assignee: Barrier Systems, LLC, Kula, Maui, HI (US)

( * ) Notice: Subject to any disclaimer, the term of this patent is extended or adjusted under 35 U.S.C. 154(b) by 197 days.

(21) Appl. No.: 12/500,367

(22) Filed: Jul. 9, 2009

(65) Prior Publication Data

US 2011/0005636 A1 Jan. 13, 2011

(51) Int. Cl.
*B65B 37/00* (2006.01)
*B66C 23/00* (2006.01)

(52) U.S. Cl. ..... 141/237; 141/10; 141/231; 141/234; 141/314; 141/315; 414/725

(58) Field of Classification Search ..... 141/10, 141/114, 231, 234–237, 248, 314–316; 414/725; 53/469

See application file for complete search history.

(56) References Cited

U.S. PATENT DOCUMENTS 4,184,522 A * 1/1980 Waite ..... 141/231
5,004,022 A * 4/1991 Carlsson ..... 141/114
5,417,261 A * 5/1995 Kanzler et al. ..... 141/313
5,564,886 A * 10/1996 Emerson et al. ..... 414/725
5,806,576 A 9/1998 Sutherlin
5,873,396 A * 2/1999 Biebrach et al. ..... 141/231
5,885,053 A * 3/1999 Deye ..... 414/722
5,894,871 A * 4/1999 Greer ..... 141/231
5,988,237 A 11/1999 Bedsole
6,161,600 A * 12/2000 Borkes ..... 141/313
7,004,713 B2 * 2/2006 Sweningson ..... 414/725
7,510,365 B2 * 3/2009 Babiarz ..... 414/725
2005/0076971 A1 4/2005 Summerville
2006/0090812 A1 5/2006 Summerville

* cited by examiner

*Primary Examiner* — Timothy L Maust
(74) *Attorney, Agent, or Firm* — Leighton K. Chong

(57) ABSTRACT

An implement for mechanically filling multiple sandbags at a time is used on a loader bucket of loader-type equipment. The implement has a planar surface in which a plurality of filler apertures are formed in a plurality of rows evenly spaced over its surface area. Each filler aperture has a tensioner ring around the aperture for holding a drawstring held in a sleeve around an open end of the sandbag. A trigger mechanism is movable to a locked position in which the drawstring of the sandbag is pulled tight so that the open end of the sandbag is held in place on the tensioner ring, to an unlocked position in which the trigger mechanism lifts the drawstring off the tensioner ring to allow the sandbag filled with filler material to pull on and cinch the open end of the sandbag closed, and to a release position in which the cinched sandbag is released to the ground.

18 Claims, 12 Drawing Sheets

TOP VIEW

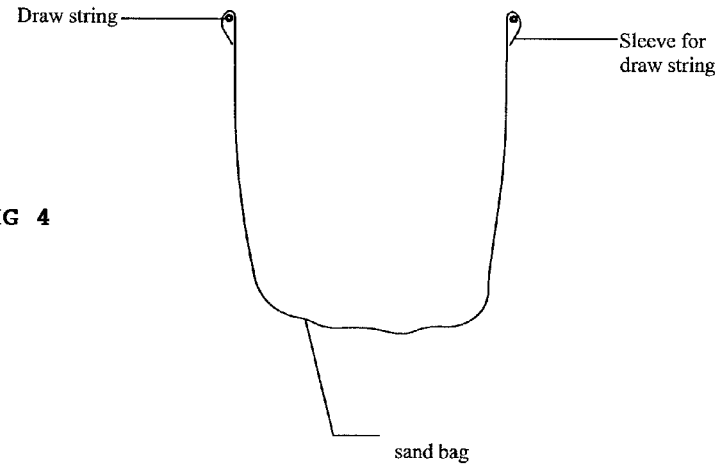
FIG 4
FIG 5
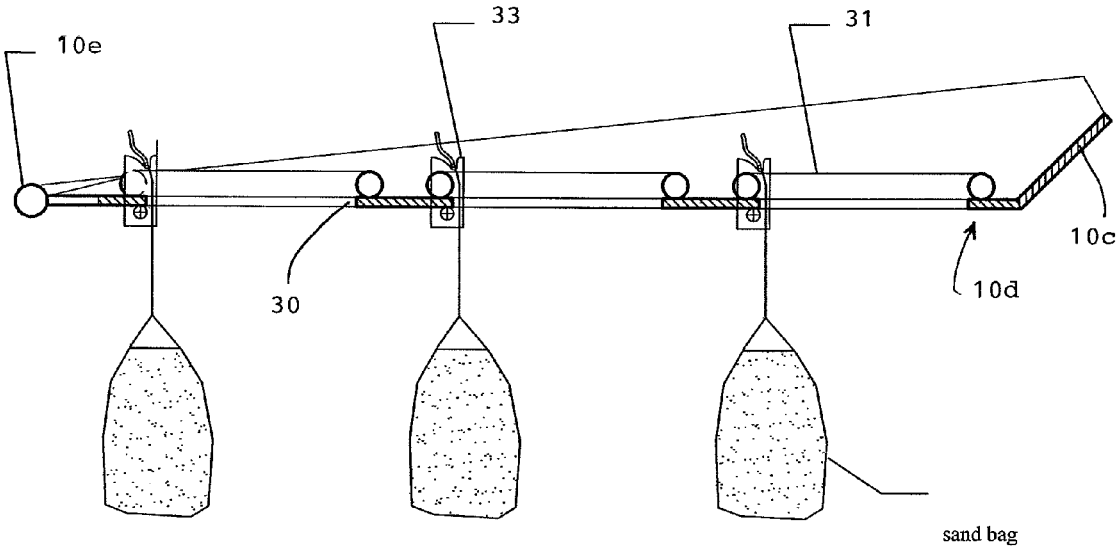

TOP VIEW

SECTION

TOP VIEW

SECTION

FIG 7A
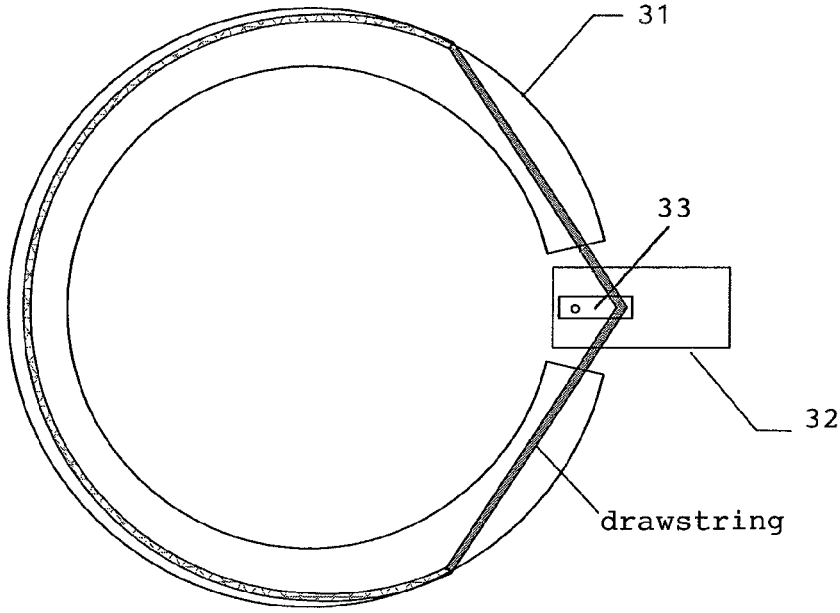
TOP VIEW
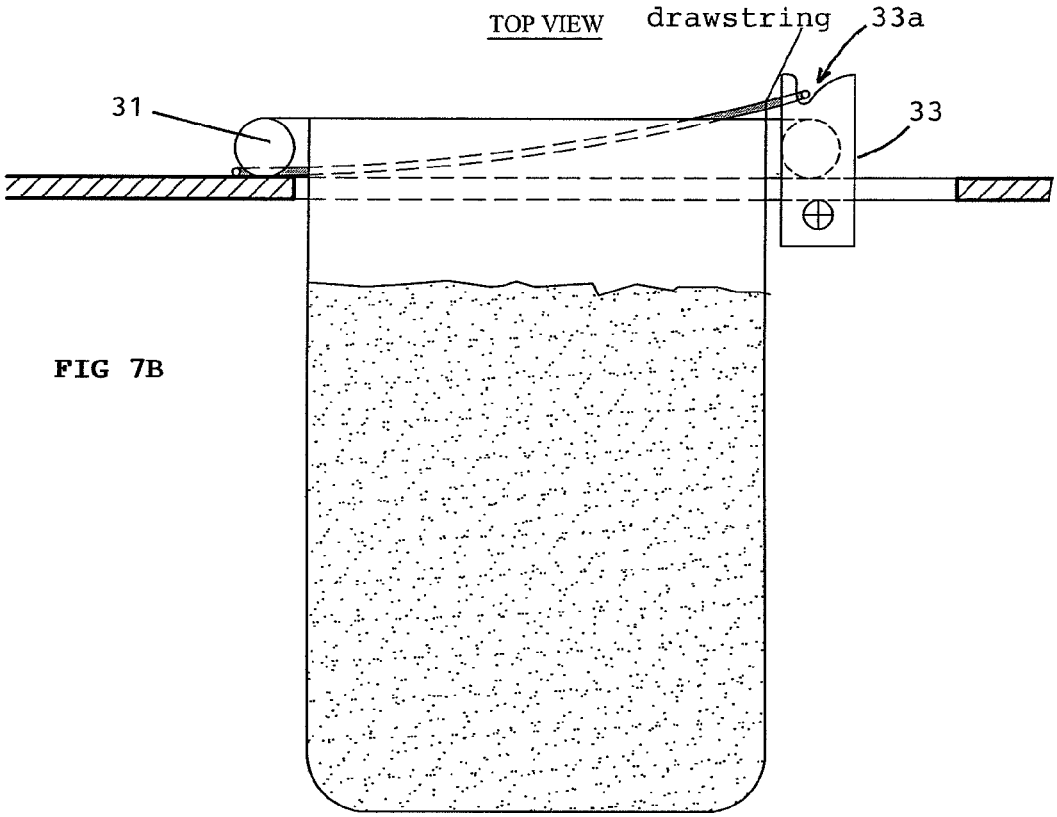
FIG 7B
SECTION

TOP VIEW

SECTION

SIDE VIEW

END VIEW

DEVICE AND METHOD FOR FILLING MULTIPLE SANDBAGS AT A TIME

FIELD OF INVENTION

The present invention relates to a device and method for mechanically filling multiple sandbags at a time at a site where sandbags are to be piled for flood control, and particularly to a mechanical system that facilitates cinching the filled sandbags, positioning them to be dropped to the ground, and controlling the manner and timing with which they are dropped.

BACKGROUND OF INVENTION

For controlling unexpected floods, sand bags are commonly filled using shovels or hand implements so that they can be piled in massed piles or along makeshift revetments for flood control. Due to the hard labor required and the short time available in emergency conditions, it would be desirable to have a more convenient way to fill as many sandbags at a time as possible. Some prior systems have employed a sand hopper on the tailgate of the loader of a dump truck to fill sandbags, such as described in U.S. Pat. No. 3,602,402 to Garden, or U.S. Pat. No. 4,585,041 to Cavanaugh. However, the ability to back a dump truck close to the site of flooding may be limited by road accessibility and/or by the limited mobility of a dump truck. Other proposals call for using a filling stand or conveyor with an overhead hopper for filling bags down one or more chutes or bag holders, such as described in U.S. Pat. No. 4,184,522 to Waite, U.S. Pat. No. 5,893,260 to McKenna, or U.S. Pat. No. 6,006,801 to Litwak. However, this approach has problems of limited accessibility for towing or the time required for assembling a filling stand or conveyor equipment near a flood site.

Other proposals have provided for fitting a hydraulically-operated loader bucket of earthmover or loader-type equipment with an augur or filler gate, such as shown in U.S. Pat. No. 5,004,022 to Carlsson, U.S. Pat. No. 5,827,038 to Barden, U.S. Pat. No. 5,829,949 to Brown, U.S. Pat. No. 7,004,713 to Sweningson, U.S. Pat. No. 7,510,365 to Babiarz, U.S. Published Patent Application 2004/0253088 to Sweningson, U.S. Published Patent Application 2004/0258508 to Jewell, or U.S. Published Patent Application 2007/0243053 to Babiarz. While loader-type equipment has the desired mobility for maneuvering near a flood site for sandbag filling and piling, the prior proposals are limited in the number of bags that can be filled at a time from a loader bucket. It would be desirable to provide a way to readily fill as many sandbags at a time as possible while employing the mobility of loader-type equipment.

SUMMARY OF INVENTION

In accordance with the present invention, a device for filling multiple sandbags using a loader bucket of loader-type equipment comprises a bag-filling implement having an attachment mechanism for attachment to the loader bucket of the loader-type equipment so that it can be maneuvered to scoop filler material onto the implement, and a planar surface having a plurality of filler apertures arranged in a plurality of rows and evenly spaced over its surface area, said filler apertures each having a tensioner ring around the aperture for holding a drawstring held in a sleeve around an open end of the sandbag, and a trigger mechanism which is movable to a locked position in which the drawstring of the sandbag is pulled tight so that the open end of the sandbag is held in place on the tensioner ring, to an unlocked position in which the trigger lifts the drawstring off the tensioner ring to allow the sandbag filled with filler material to pull on and cinch the open end of the sandbag closed by the weight of the filled sandbag on the drawstring, and to a release position in which the cinched sandbag is released to the ground.

In a preferred embodiment, the bag-filling implement is held by attachment hooks along a back edge of the loader bucket and maneuvered by a hydraulic ram or a scoop component of the loader bucket. The apertures in each row are spaced in offset manner from those of the other rows. The trigger mechanisms of all of the apertures in each row are all aligned on the same side and rotated by a pivot shaft extending laterally across the surface width on the underside of the planar surface of the implement. The pivot shafts terminate in respective pivot gears which are engaged with a toothed rack or bar that is moved linearly bidirectionally by a hydraulic ram to turn the pivot gears in the desired rotational directions. In this manner, all of the sandbags can be cinched closed and released to the ground without the need for the intervention of workers, thereby ensuring their convenience and safety.

Preferably, the upper rim of the sandbag is formed with a sleeve within which a drawstring is positioned. In an open or mounting position, the drawstring is laid over the tensioner ring of a filler aperture of the implement. The trigger mechanism is rotated to a horizontal (3 o'clock) position to pull the drawstring taut and lock the open end of the sandbag on the tensioner ring. When the sandbag has been filled with sand, the trigger mechanism is rotated to an upright (12 o'clock) position to slacken the drawstring and allow the open end of the sandbag to pull off from the tensioner ring and the weight of the filled sandbag to pull on the drawstring to cinch the open end of the sandbag closed by the weight of the filled sandbags. When the implement is positioned over the area where the sandbags are to be dropped, the trigger mechanisms are rotated counterclockwise further (past the 9 o'clock position) to release the sandbags to the ground.

As a further feature of the invention, the trigger mechanisms for the rows of filled sandbags may be configured for controlling the manner and timing with which the sandbags are dropped to the ground. In a preferred embodiment, the pivot gears for actuating respective rows of trigger mechanisms have stepped ratios of gear sizes so that a first row can be actuated to the release position, while a second row is in the unlocked position, and a third row is in the locked position. In this manner, the loader equipment can position the bag-filling implement over the area where a first row of sandbags is to be released, then reposition for release of the second row of sandbags, etc.

Other objects, features, and advantages of the present invention will be explained in the following detailed description of the invention having reference to the appended drawing.

BRIEF DESCRIPTION OF DRAWINGS

FIG. 4 illustrates the construction of a sandbag for use with the bag-filling implement.

FIG. 5 is a sectional side view showing the bag-filling implement with filler apertures, tensioner rings, and trigger mechanisms for the sandbags.

FIGS. 7A and 7B are top and sectional views, respectively, illustrating the sandbag being unlocked from the tensioner ring.

DETAILED DESCRIPTION OF INVENTION

Figure 1:
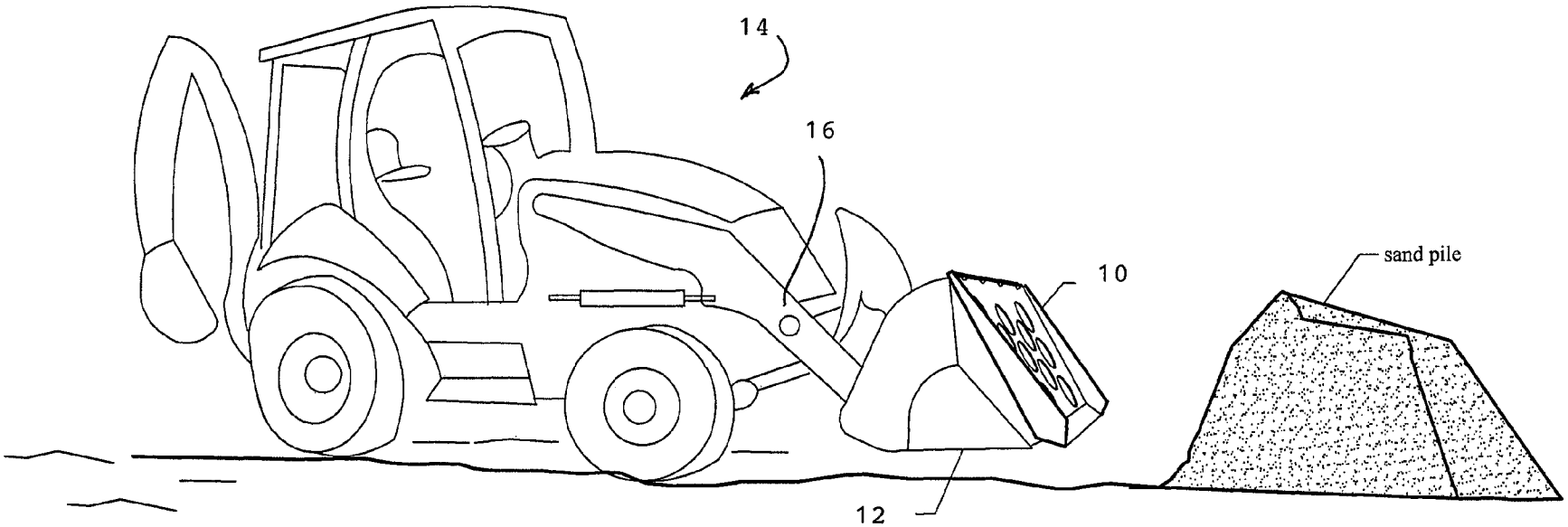
FIG. 1 illustrates a multiple sandbag-filling implement mounted on a loader bucket of loader-type equipment for filling multiple sandbags at a time.

Referring to FIG. 1, a front loader is shown having a multi-bag filling implement 10 attached to the open end of a hydraulically actuated loader bucket 12 of an earthmover or loader-type equipment 14. The bag-filling implement 10 has multiple rows each with multiple filler apertures 10*a* spaced over its operative surface area. The loader-type equipment 14 has a high mobility of movement to scoop sand from a sand pile and push the sand onto the bag-filling implement 10 using its hydraulic arms 16 to manipulate the loader bucket 12. The loader equipment can then elevate the loader bucket with the bag-filling implement 10, and deposit the filled sandbags from the implement at the site where they are to be piled for flood control or simply drop them in offset rows in their final positions. This eliminates the need for laborers to engage in filling the sandbags by hand and carrying them to the site where they are to be piled.

Figure 2A:
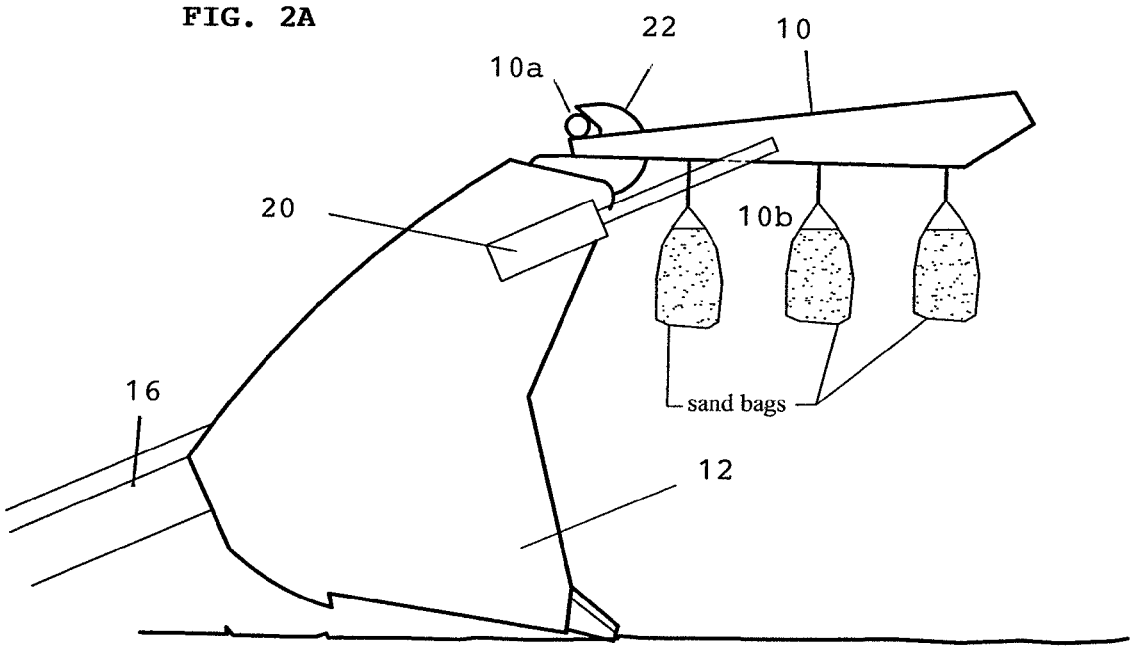
FIGS. 2A and 2B illustrate the bag-filling implement on a standard loader bucket and on a standard 4&1 bucket, respectively.

FIG. 2A illustrates the bag-filling implement 10 on a standard bucket loader equipment which has a hydraulic ram 20 for controlling bucket attachments. A back edge 10*a* of the bag-filling implement 10 is held by attachment hooks 22 positioned along a back 10*a* of the bag-filling implement 10 is held by attachment hooks 22 positioned along a back edge of the loader bucket 12, and the end of the hydraulic ram 20 is coupled to a mid-length attachment point 10*b* of the bag-filling implement 10. With the hydraulic ram 20 extended, the bag-filling implement 10 is placed in a horizontal position, and the loader bucket 12 is rotated downward to clear the space beneath the bag-filling implement 10 where the sandbags are suspended. Using a gear-actuated trigger mechanism (to be described in detail below), the sand-filled bags are released from respective holder rings around the filler apertures of the bag-filling implement and cinched closed by gravity suspended in a vertical position by their attached drawstrings. When the loader arm is positioned over the site where the sandbags are to be dropped, the trigger mechanism is actuated to release the ends of the drawstrings and allow the sandbags to drop to the ground where flood control workers can tie them off and pile them where desired.

Figure 2B:
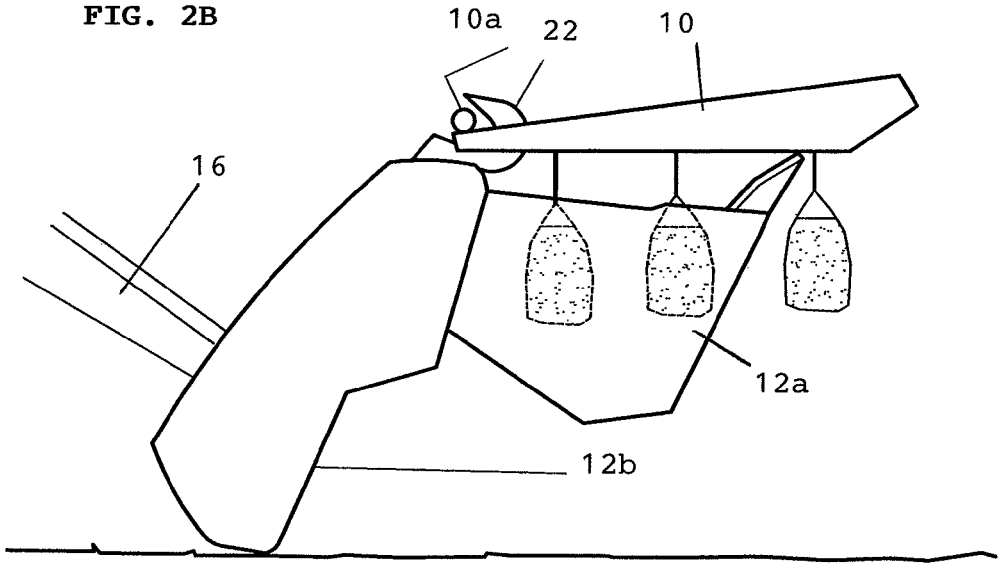

In FIG. 2B, an alternative loader bucket of the "4&1" type has a scoop 12*a* movable from the bucket 12*b* which is elevated to hold the bag-filling implement 10 in the horizontal position, while the bucket 12*b* is rotated downward to clear the space beneath the sandbags. The scoop 12*a* has an empty bottom that leaves a clear space through its mid-section through which the sandbags can drop.

Figure 3:
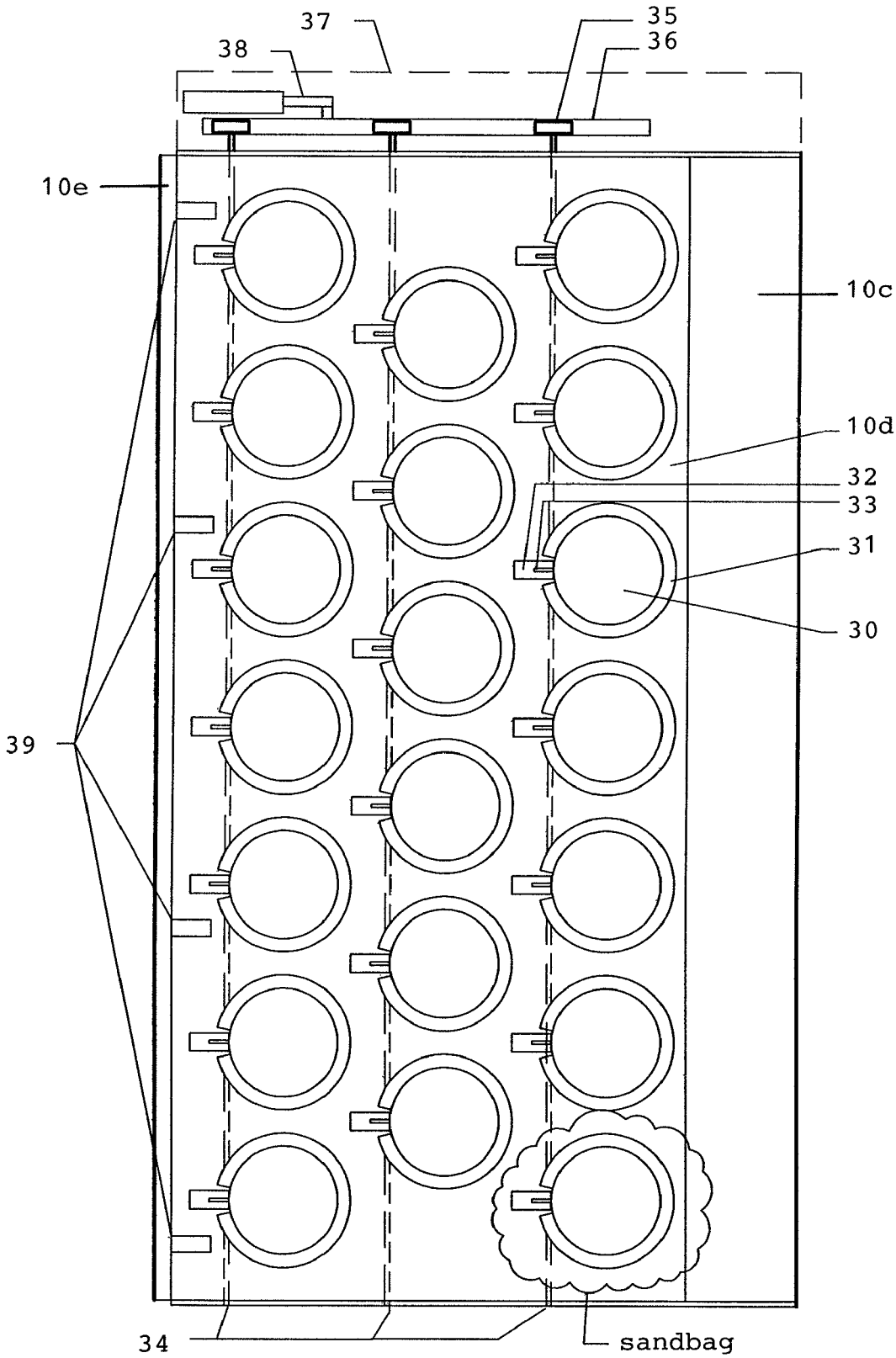
FIG. 3 shows a top view of the bag-filling implement with rows of bag-filler apertures and rack-and-gear mechanism for actuating trigger mechanisms for locking, unlocking, and releasing the sandbags from respective tensioner rings.

FIG. 3 shows a top view of the bag-filling implement 10 having an inclined front scoop portion 10*c* and tapered side walls and a planar surface area 10*d* on which multiple (3) rows of bag-filler apertures 30 are spaced evenly over the planar surface area. Each bag-filler aperture 30 is surrounded by a tensioner ring 31 for holding the drawstring loop (to be described in further detail below) for a sandbag that is inserted within and suspended below the aperture opening to receive sand pushed onto the planar surface of the implement 10 for loading into the apertures and sandbags therein. The tensioner ring 31 surrounds the aperture 30 circumferentially except at a cutout portion on one side within which a trigger slot 32 is formed in the planar surface of the implement for mounting a rotatable trigger mechanism 33 for locking, unlocking, and releasing the drawstring of the sandbag (to be described in further detail below).

bucket of the loader-type equipment on which it will be used. For example, for the bucket size on a Caterpillar 420E equipment, the preferred overall dimensions of the flat (planar) portion of the implement 10 is 90"×38" with the end of the bucket kick of 8" at 30 degrees angle. The depth of the scoop portion tapers from front to back, with an average depth of 4". The implement is made of ⅜" thick steel plate. The sandbag apertures are preferably 8" in diameter but the sand fills the bag out to a full 10" diameter below the steel plate. The apertures are preferably 26 in number, with a first row having 9 apertures, the middle row having 8 apertures and the last row having 9 apertures. Each tension ring has an outside diameter of 8", and the ring is made of round steel rod ¾ in O.D.

The trigger mechanisms 33 of all of the apertures in each row are all aligned on the same side and are rotated by a pivot shaft 34 extending laterally across the surface width on the underside of the planar surface of the implement 10. On one lateral side of the implement 10, within a protective box 37 (in dashed lines), the pivot shafts 34 terminate in respective pivot gears 35 which are engaged with a toothed rack or bar 36 that is moved linearly bidirectionally by a hydraulic ram 38 to turn the pivot gears 35 in the desired rotational directions. On the back edge of the implement 10 are a number of attachment slots 39 and a load-bearing bar 10*e* of the implement for attachment on the back edge of the loader bucket.

FIG. 4 illustrates the construction of a sandbag for use with the bag-filling implement. The upper rim of the sandbag is formed with a sleeve within which a drawstring is positioned. In the open position, the drawstring is laid over the tensioner ring of a filler aperture of the implement. The sandbag is sized for a desired weight for flood piling when filled.

FIG. 5 is a sectional side view of the bag-filling implement showing its front scoop portion 10*c*, planar surface area 10*d*, and back bearing bar 10*e* and attachment slots 39. The sandbag filler apertures 30 and tensioner rings 31 are spaced over the planar surface area of the implement. The trigger mechanisms are shown rotated upright (to the 12 o'clock position) in which the drawstrings have been loosened (unlocked) from the tensioner rings 31 and cinched tightly closed by the falling weight of the filled sandbags. The ends of the drawstrings are retained in notches on the ends of the trigger mechanisms. When the implement is positioned over the area where the sandbags are to be dropped, the trigger mechanisms are rotated further (to the 9 o'clock position) to release the sandbags. The cinching of the sandbags is very tight and there is no need to re-cinch or tie the bags once on the ground.

The bag-filling implement can be quickly mounted on a standard backhoe bucket or a 4&1 type loader bucket and uses the machine's existing hydraulic systems to operate. The implement shown is capable of filling 20 sandbags at a time, cinching them closed using gravity, and positioning them to be dropped to the ground where needed. By simply changing the size of the implement, it can be adapted for use on any size of loader equipment. Also, the implement can easily be changed and made to use much larger sandbags. The same system can be used to fill the bags with dirt or gravel where sand is unavailable. The gear-actuated trigger mechanisms allow all the sandbags in a lot to be drawn closed and released to the ground without risking human intervention.

Figure 6A:
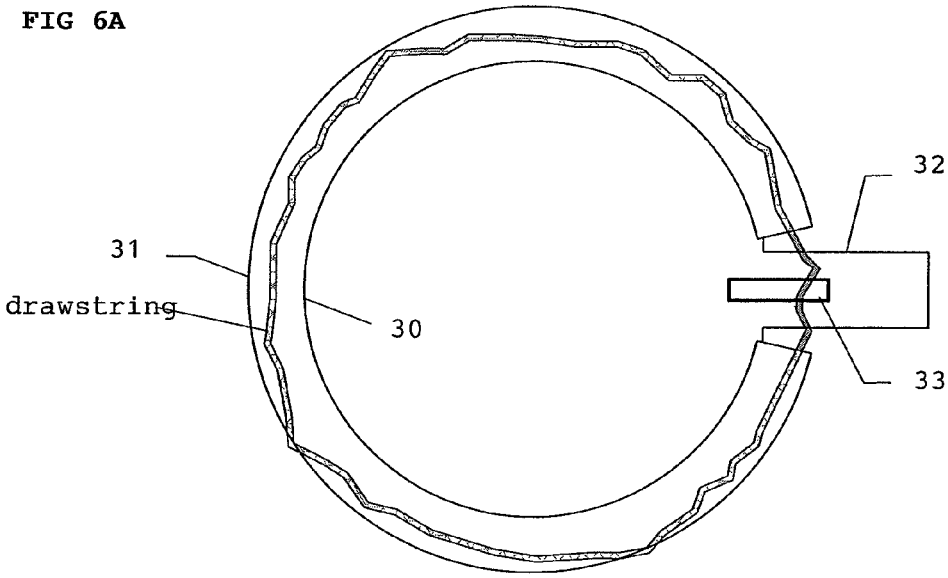
FIGS. 6A and 6B are top and sectional views, respectively, illustrating the mounting of a sandbag by its drawstring on a tensioner ring.
Figure 6B:
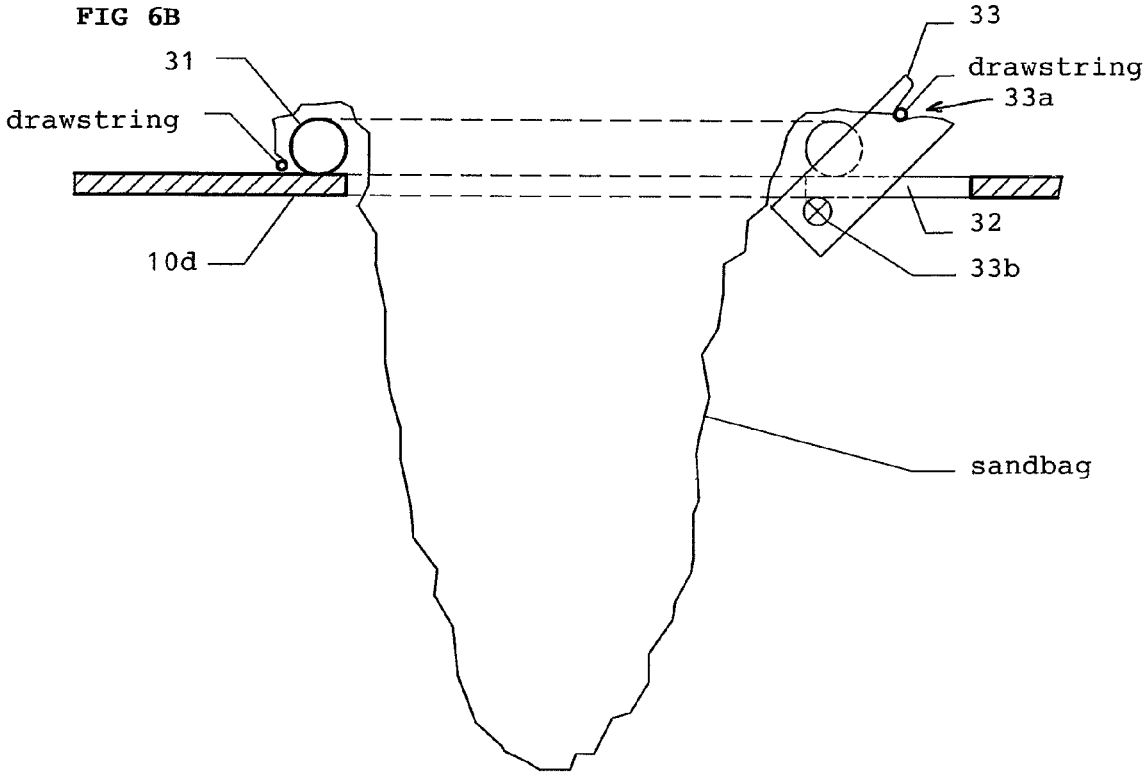

FIGS. 6A and 6B are top and sectional views, respectively, illustrating the mounting of a sandbag by its drawstring on a tensioner ring. The open end of the sandbag is open to its full diameter with the drawstring extended out in its sleeve formed on the sandbag and laid over the outside of the tensioner ring 31 and the body of the sandbag is inserted into the filler aperture 30 to hang below the planar surface 10*d* of the implement 10. The section of the drawstring that is exposed at the ends of the sandbag sleeve is aligned with the cutout portion of the tensioner ring 30 and fitted into the notch 33*a* on one end of the trigger 33. The trigger 33 for each aperture is rotatable clockwise on its pivot pin axis 33*b* when the pivot gear is rotated by the ram actuator (see FIG. 3) for turning the pivot shaft actuating the triggers for a row of apertures for mounting. The trigger 33 is rotated to an intermediate angle (about the 1 o'clock position in the figure) where the drawstrings of the sandbags can be mounted on the tensioner rings and triggers, prior to being rotated to the locked position (3 o'clock position).

Figure 6C:
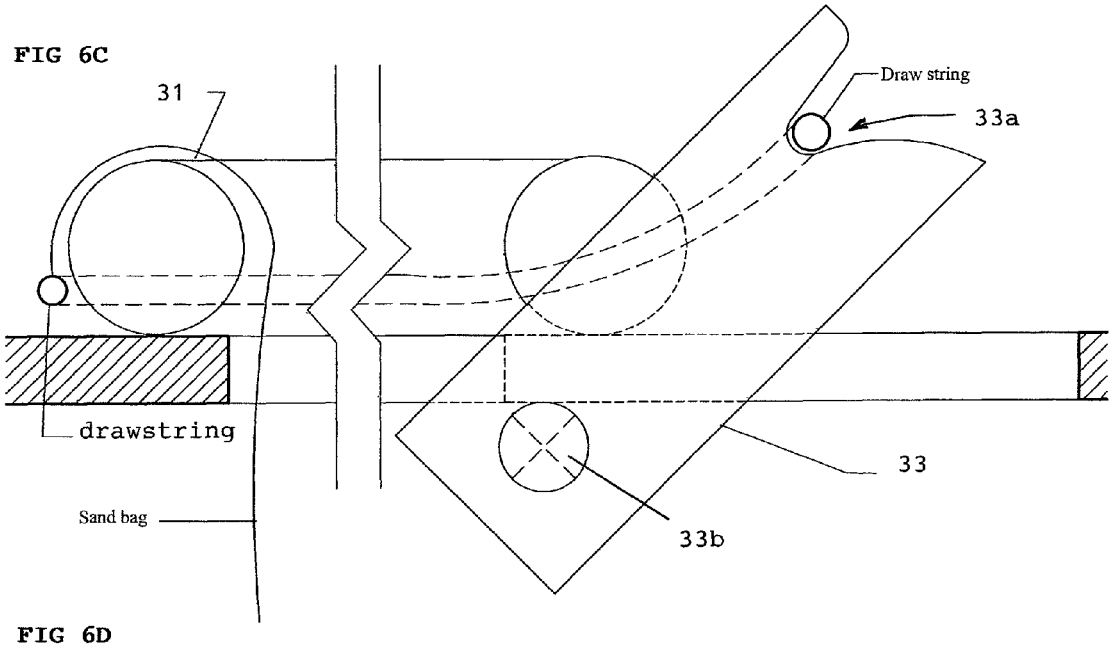
FIGS. 6C and 6D are detailed sectional views illustrating the trigger for holding the sandbag in the loading position and in the locked position, respectively.
Figure 6D:
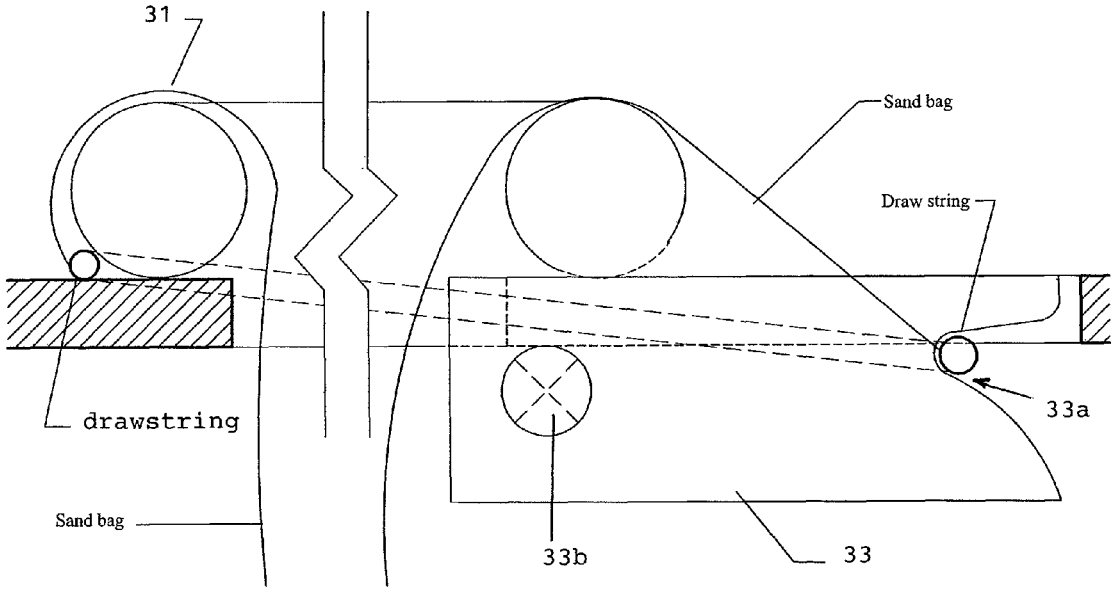

FIGS. 6C and 6D are detailed sectional views illustrating the locking of the sandbag by its drawstring on the tensioner ring. The section of the drawstring that is fitted into the notch 33*a* on the end of the trigger 33 is drawn snug around the tensioner ring 30 as the trigger 33 is rotated on its pivot pin axis 33*b* downward. When the trigger 33 is rotated into the trigger slot 32 in the horizontal position (3 o'clock position), the extension of the trigger end pulls the drawstring very tight around the tensioner ring 30 to lock the sandbag with its open end held in place around the tensioner ring.

Figure 6E:
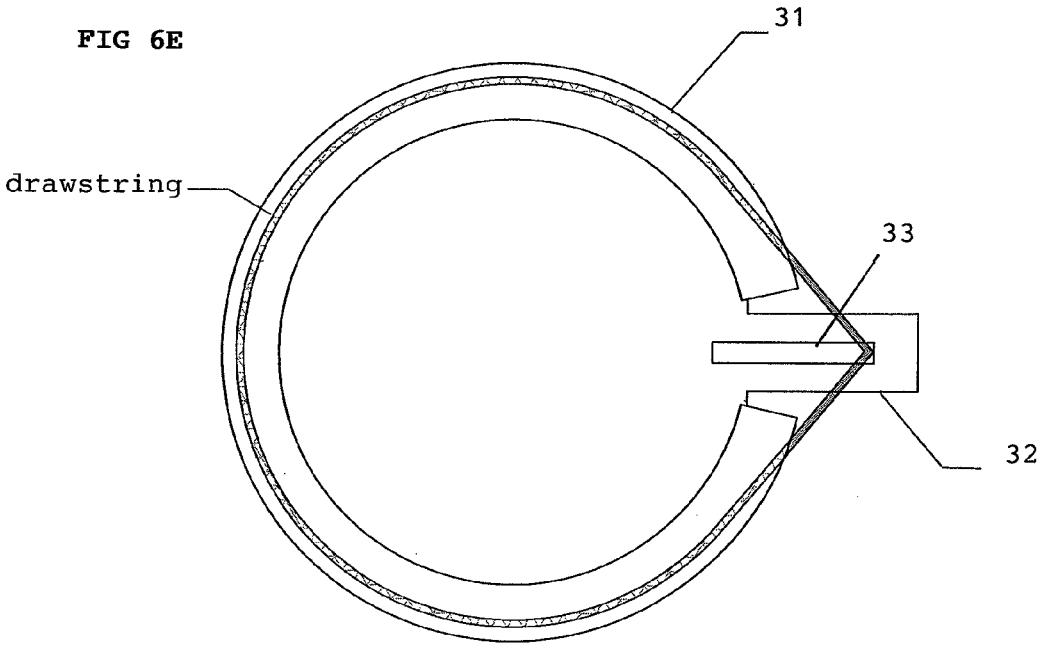
FIGS. 6E and 6F are top and sectional views, respectively, illustrating the sandbag
Figure 6F:
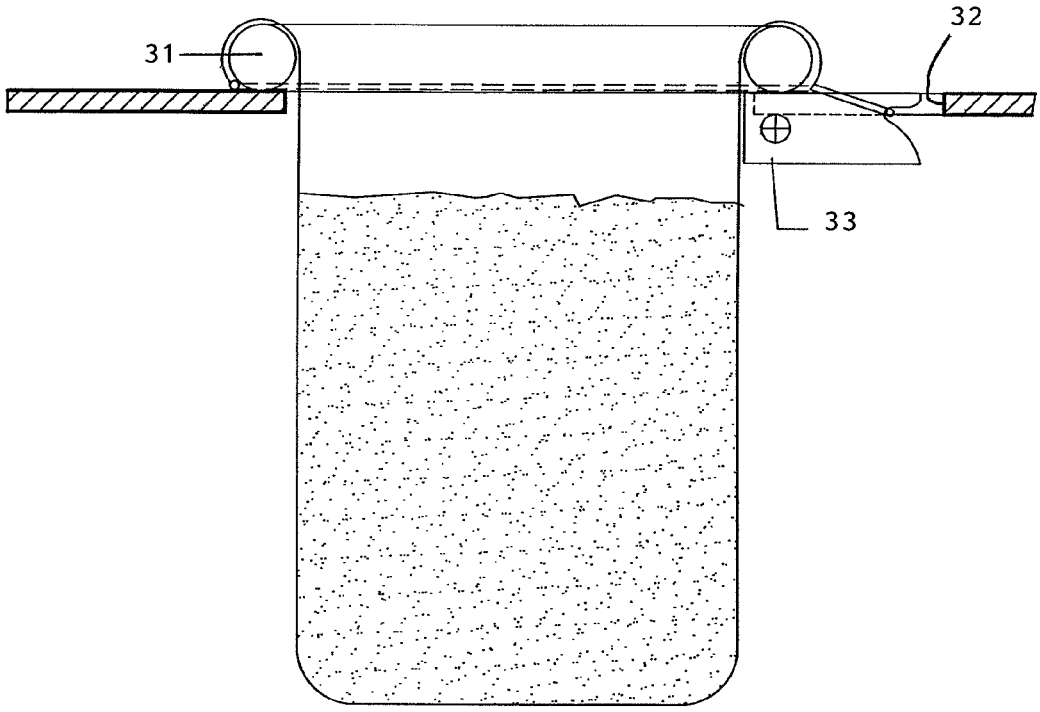

FIGS. 6E and 6F are top and sectional views, respectively, illustrating the sandbag locked by its drawstring on the tensioner ring. The drawstring in the locked position is drawn very tight around the tensioner ring 31. As the implement is pushed by the loader equipment to scoop sand from a sandpile, the force of the sand being loaded into the sandbag pulls the bag taut and the drawstring even tighter to avoid dislodging of the sandbag under the filling forces.

FIGS. 7A and 7B are top and sectional views, respectively, illustrating the sandbag being unlocked from the tensioner ring. When the pivot gear for turning the shaft to actuate the triggers for a row of apertures is rotated by the ram actuator moving the linear rack in the opposite direction (see FIG. 3), the trigger is rotated counterclockwise from the horizontal (3 o'clock) locked position to the upright (12 o'clock) unlocked position. As the trigger moves from the locked position to the unlocked position, it slackens the drawstring and lifts the leading sections out from under the tension ring 31. In the upright trigger position, the drawstring end on the end of the trigger 33 is lifted high enough above the tensioner ring 31 that the weight of the sandbag can pull off the back section of the sleeved drawstring off the tensioner ring 31.

Figure 7C:
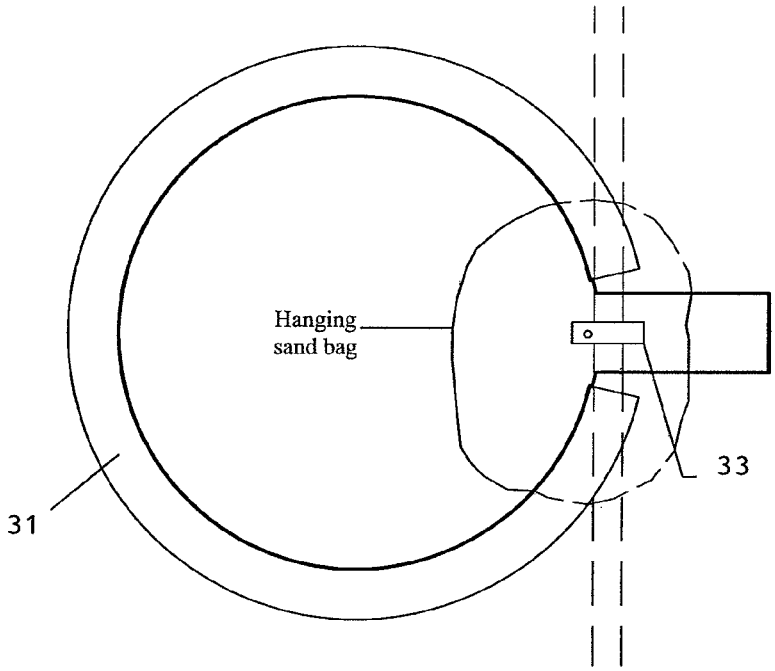
FIGS. 7C and 7D are top and sectional views, respectively, illustrating the sandbag cinched and suspended by the drawstring on the trigger in the unlocked position.
Figure 7D:
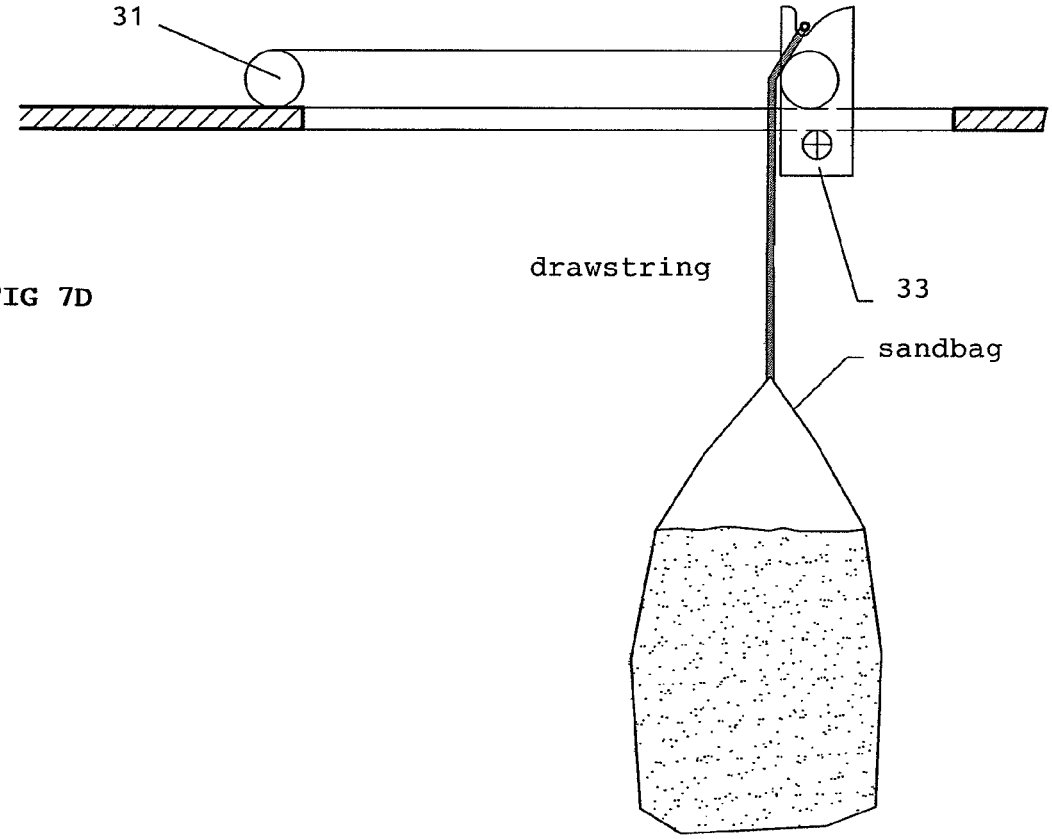

FIGS. 7C and 7D are top and sectional views, respectively, illustrating the sandbag being suspended by its drawstring from the trigger mechanism in the unlocked position. As the sand bag pulls the drawstring off the tension ring 31, its falling weight starts to pull the drawstring sleeve closed. When the sand bag hits the end of the drawstring length with one end held by the trigger, the violent stop of the pulling force of the weight of the filled bag cinches the other end of the drawstring to pull the sleeved end closed tight. The sand compacting under the gravity force combined with the collapsing of the bag shape results in a certain volume being left unfilled in the head portion of the bag. When the bag is released to the ground, this unfilled volume in the bag leaves enough room for the drawstring to be cinched and knotted around the end of the bag.

Figure 7E:
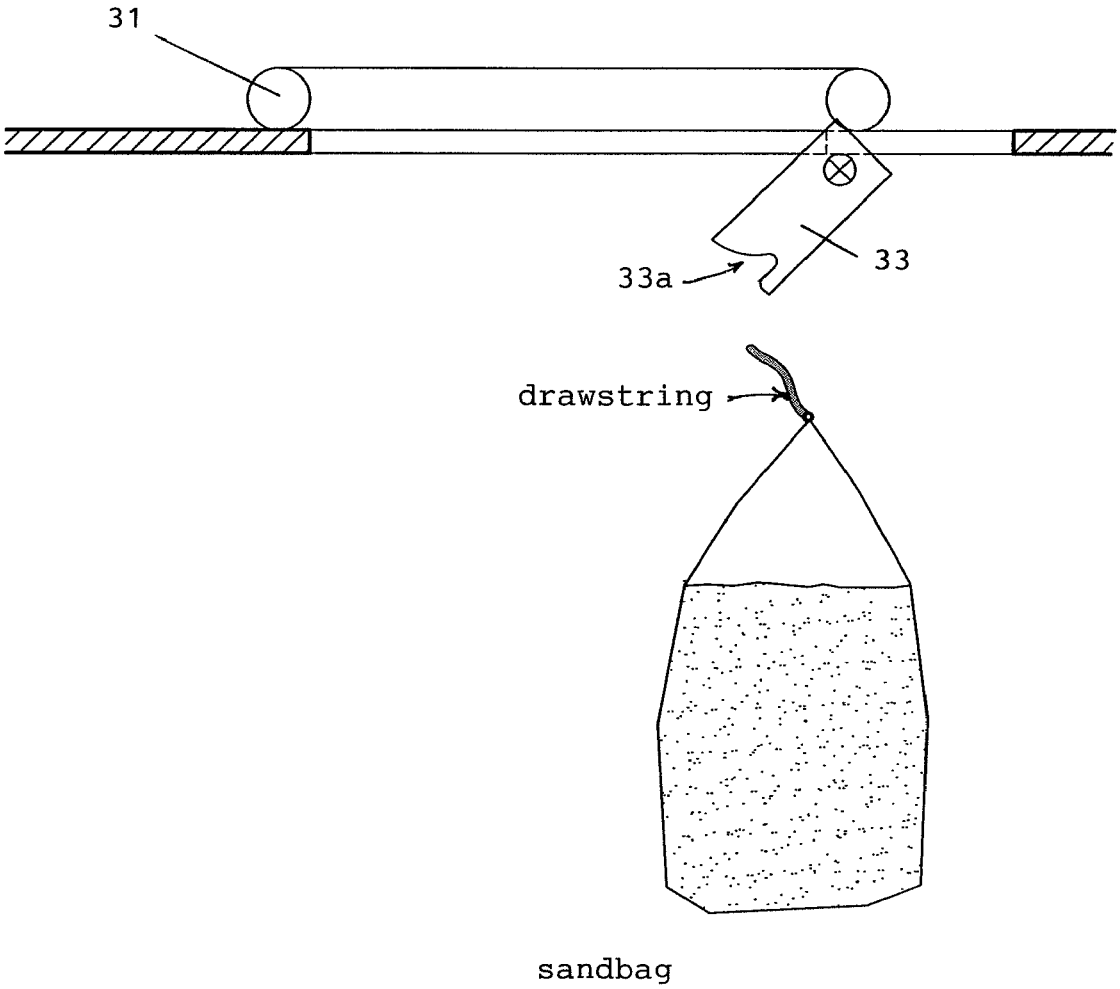
FIG. 7E illustrates the sandbag being released to the ground by the trigger mechanism in the release position.

FIG. 7E illustrates the sandbag being released to the ground by the trigger mechanism in the release position. When the loader equipment has maneuvered the bag-filling implement over the areas where the sandbags are to be dropped, the pivot shaft is further rotated and the triggers for each row of apertures are rotated counterclockwise from the upright (12 o'clock) unlocked position to the past horizontal (below 9 o'clock) release position on the release side. The drawstring end is thus released from the notch 33*a* on the end of the trigger 33 to allow the sandbag to fall to the ground. When the sandbags are dropped from the implement, they fall to the ground in close spacing with each other in a bricklayered-like pattern. For some piling formations, this may be the desired end placement of the sandbags and would not require any further moving or piling by workers.

In the embodiment shown, the preferred length of the trigger, from the center of the pivot point, is 2⅛" to the "saddle" or "notch" of the trigger. The overall length of the trigger from center of the pivot point is 2⅞", and the depth of the notch at the top of the trigger is ¾". For an aperture of 8" diameter, the preferred circumferential length of the drawstring is about 25" to obtain a requisite tautness when the trigger is in the locked position.

The sandbag is designed to be used by the bag-filling implement as described above. It has a sandbag volume formed by a closed end, an open end communicating into the sandbag volume for filling fill material therein, a sleeve formed along an upper edge of the open end for holding a drawstring therein, and a drawstring held in the sleeve. The drawstring has a length, such as 25" circumferential length on a tension ring 8" in diameter. This is designed to enable the drawstring to be drawn taut when pulled by the trigger mechanism to the locked position so that the open end is held in place over the tensioner such as 20 to 30 pounds when filled. For example, a sandbag usable with the 20-aperture configuration for typical backhoe equipment described above may have a full diameter (below the implement) of about 10 inches and a length of about 24 inches, depending on the desired weight when it is filled.

Figure 8A:
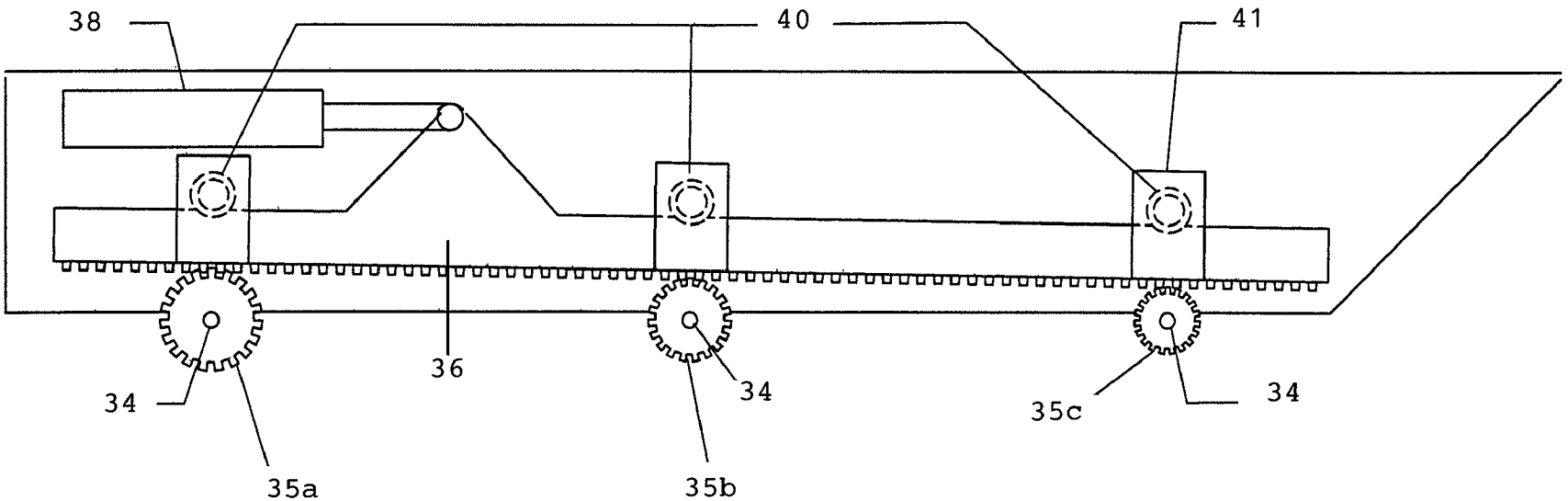
FIGS. 8A and 8B are side elevation and end views, respectively, of a pivot gear mechanism for actuating the rows of trigger mechanisms for the sandbags.
Figure 8B:
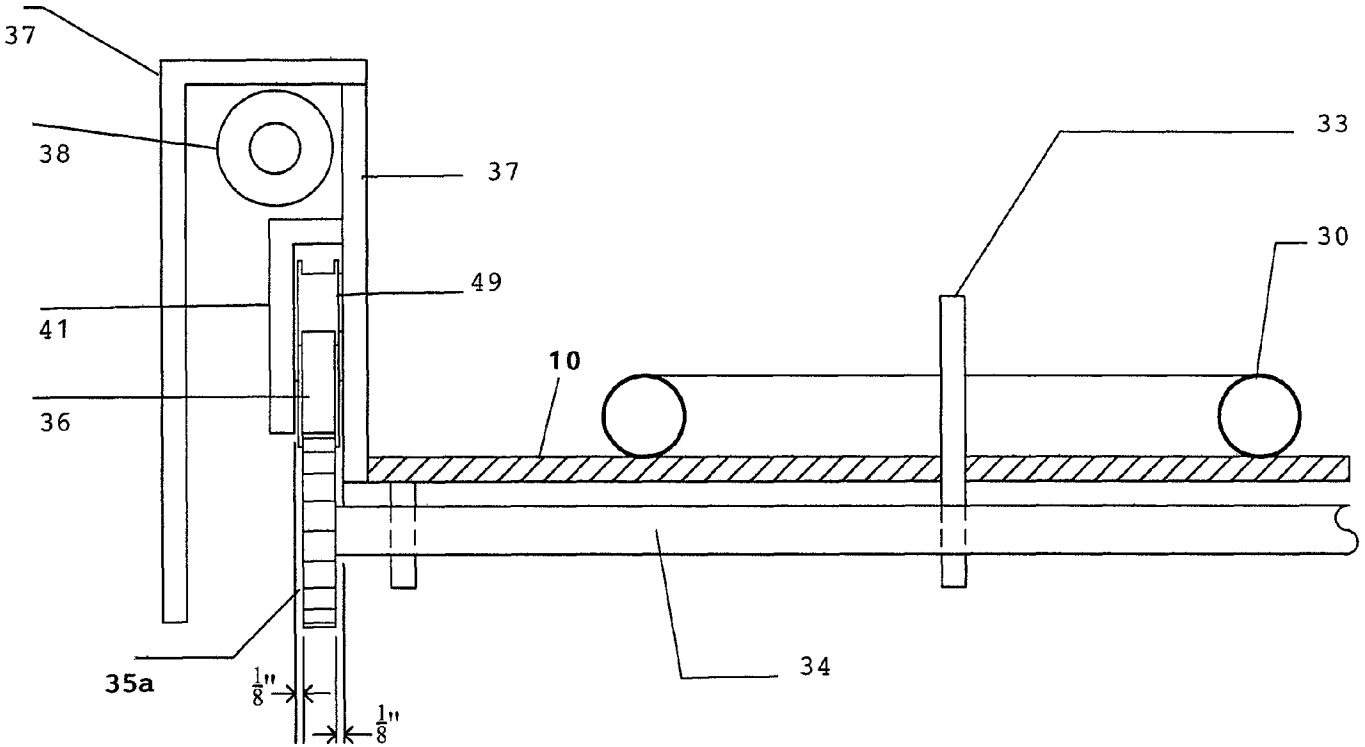

FIGS. 8A and 8B are side elevation and end views, respectively, of another version of the pivot gear mechanism for actuating the rows of trigger mechanisms for the sandbags. This version is configured for controlling the manner and timing with which the sandbags are dropped to the ground. The pivot gears 35*a*, 35*b*, 35*c* on the ends of the pivot shafts 34 for actuating the respective rows of trigger mechanisms have stepped ratios of gear sizes so that each row is released in timed phases of movement of the toothed rack or bar 36 moved linearly by the hydraulic ram 38. Roller guides 40 held in bar guide retainers 41 hold the bar 36 in position. The protective box 37 protects the pivot gear, bar, and guide assembly. In a first release advancement of the bar 36, the smallest pivot gear 35*c* actuates the triggers of the first row to the release position, while a second row is in the unlocked position, and a third row is in the locked position. When the bar 36 is advanced further to a second release position, the second row of sandbags will be released, and the third row will have their triggers moved to the unlocked position. Further advancement of the bar 36 will release the third row of sandbags. In this manner, the loader equipment can position the bag-filling implement over the area where a first row of sandbags is to be released, then reposition for release of the second row of sandbags, etc.

It is to be understood that many modifications and variations may be devised given the above described principles of the invention. It is intended that all such modifications and variations be considered as within the spirit and scope of this invention, as defined in the following claims.

The invention claimed is:

1. A device for mechanically filling multiple sandbags for use on a loader bucket of loader-type equipment comprising:

a bag-filling implement having an attachment mechanism for attachment to the loader bucket of the loader-type equipment so that it can be maneuvered to scoop filler material onto the implement, and a planar surface having a plurality of filler apertures arranged in a plurality of rows and evenly spaced over its surface area, wherein said filler apertures each have a tensioner ring around the aperture for holding a drawstring in a sleeve around an open end of the sandbag thereon, and a trigger mechanism which is movable to a locked position in which the drawstring of the sandbag is pulled tight so that the open end of the sandbag is held in place on the tensioner ring, to an unlocked position in which the trigger mechanism lifts the drawstring off the tensioner ring to allow the sandbag filled with filler material to pull on and cinch the open end of the sandbag closed by the weight of the filled sandbag on the drawstring, and to a release position in which the cinched sandbag is released to the ground.

2. A device according to claim 1, wherein said bag-filling implement is held by attachment hooks along a back edge of the loader bucket of a standard loader equipment and maneuvered by a hydraulic ram coupled to an attachment point on said implement.

3. A device according to claim 1, wherein said bag-filling implement is held by attachment hooks along a back edge of the loader bucket of a standard 4&1 type loader equipment and maneuvered by a scoop component of the loader bucket.

4. A device according to claim 3, wherein said bag-filling implement has a plurality of attachment slots along a bearing bar on its back edge into and on which attachment hooks provided along the back edge of the loader bucket are engaged.

5. A device according to claim 1, wherein said bag-filling implement has an inclined front scoop portion for scooping filler material onto its planar surface.

6. A device according to claim 1, wherein said bag-filling implement has the trigger mechanisms of all of the apertures in each row aligned on the same side and coupled for rotation by a pivot shaft extending laterally across the surface width on the underside of the planar surface of said implement.

7. A device according to claim 6, wherein said bag-filling implement has the pivot shafts terminating in respective pivot gears which are engaged with a toothed rack or bar that is moved linearly bidirectionally to turn the pivot gears in the desired rotational directions.

8. A device according to claim 7, wherein said toothed rack or bar is moved linearly by a hydraulic ram of the loader-type equipment.

9. A device according to claim 1, wherein each said trigger mechanism is a component rotatable in a trigger slot on a pivot pin axis coupled to the underside of the planar surface of said implement, and has a notch on a free end thereof for holding an end of a drawstring of a sandbag therein.

10. A device according to claim 9, wherein said trigger mechanism is rotatable to a horizontal (3 o'clock) position in a direction away from the tensioner ring to pull the drawstring taut and lock the open end of the sandbag on the tensioner ring, and when the sandbag has been filled with sand, the trigger mechanism is rotated to an upright (12 o'clock) position to slacken the drawstring and allow the open end of the sandbag to pull off from the tensioner ring and to cinch the open end of the sandbag closed by the weight of the filled sandbags on the drawstring, and when the implement is positioned over the area where the sandbags are to be dropped, the trigger mechanism is rotated counterclockwise to a release (past 9 o'clock) position to release the sandbag to the ground.

11. A device according to claim 7, wherein the pivot gears have stepped ratios of respective gear sizes so that each row is released in timed phases of movement of the toothed rack or bar moved linearly by the hydraulic ram.

12. A method for filling multiple sandbags using a loader bucket of loader-type equipment comprising:

attaching a bag-filling implement to the loader bucket of the loader-type equipment so that it can be maneuvered to scoop filler material onto the implement, providing a plurality of filler apertures arranged in a plurality of rows and evenly spaced over a planar surface area of the implement, providing each of the filler apertures with a tensioner ring for holding a drawstring in a sleeve around an open end of the sandbag thereon, and a trigger mechanism which is movable to a locked position in which the drawstring of the sandbag is pulled tight so that the open end of the sandbag is held in place on the tensioner ring, to an unlocked position in which the trigger mechanism lifts the drawstring off the tensioner ring to allow the sandbag filled with filler material to pull on and cinch the open end of the sandbag closed by the weight of the filled sandbag on the drawstring, and to a release position in which the cinched sandbag is released to the ground.

13. A method according to claim 12, wherein said trigger mechanisms of all of the apertures in each row are aligned on the same side and coupled for operation together.

14. A method according to claim 13, wherein said trigger mechanisms are coupled to a pivot shaft extending laterally across the surface width on the underside of the planar surface of said implement.

15. A method according to claim 14, wherein the pivot shafts terminate in respective pivot gears which are engaged with a toothed rack or bar that is moved linearly bidirectionally to turn the pivot gears in the desired rotational directions.

16. A method according to claim 15, wherein each said trigger mechanism is a component rotatable in a trigger slot on a pivot pin axis coupled to the underside of the planar surface of said implement, and has a notch on a free end thereof for holding an end of a drawstring of a sandbag therein.

17. A method according to claim 16, wherein said trigger mechanism is rotatable to a horizontal (3 o'clock) position in a direction away from the tensioner ring to pull the drawstring taut and lock the open end of the sandbag on the tensioner ring, and when the sandbag has been filled with sand, the trigger mechanism is rotated to an upright (12 o'clock) position to slacken the drawstring and allow the open end of the sandbag to pull off from the tensioner ring and to cinch the open end of the sandbag closed by the weight of the filled sandbags on the drawstring, and when the implement is positioned over the area where the sandbags are to be dropped, the trigger mechanism is rotated counterclockwise to a release (past 9 o'clock) position to release the sandbag to the ground.

18. A method according to claim 12, which is adapted for use on a loader bucket of standard loader equipment, wherein the apertures of said bag-filling implement have an offset spacing from apertures in adjacent rows.

* * * * *